United States Patent [19]

Kirstein

[11] Patent Number: 5,041,827

[45] Date of Patent: Aug. 20, 1991

[54] APPARATUS FOR THE PREPARATION AND WIRELESS TRANSMISSION OF MEASURED VALUES

[75] Inventor: Gerhard Kirstein, Augsburg, Fed. Rep. of Germany

[73] Assignee: Renk Aktiengellschaft, Fed. Rep. of Germany

[21] Appl. No.: 403,125

[22] Filed: Sep. 5, 1989

[30] Foreign Application Priority Data

Sep. 29, 1988 [DE] Fed. Rep. of Germany ..... 3832985

[51] Int. Cl.[5] ..... G08C 19/16

[52] U.S. Cl. ..... 340/870.21; 340/870.27; 340/870.30; 375/68; 332/106

[58] Field of Search ..... 340/870.18, 870.21, 340/870.19, 870.27, 870.30; 375/41, 68, 73; 332/106, 115, 116; 364/556; 341/176

[56] References Cited

U.S. PATENT DOCUMENTS 3,764,983 10/1973 Stok ..... 340/870.21
4,295,139 10/1981 Arpino ..... 340/870.01
4,783,659 11/1988 Frick ..... 340/870.21

FOREIGN PATENT DOCUMENTS 3017425 11/1980 Fed. Rep. of Germany .
3520899 1/1986 Fed. Rep. of Germany .
3511504 10/1986 Fed. Rep. of Germany .

*Primary Examiner*—Donald J. Yusko
*Assistant Examiner*—Michael Horabik
*Attorney, Agent, or Firm*—Darby & Darby

[57] ABSTRACT

Analog measured values are processed by an A/D converter (50) and/or digital measured values are processed by a timer (60) in a microcomputer and fed through a P/S converter (62) to a logic means (42). Furthermore, RF pulses are fed by an oscillator means (44) to an additional input of the logic means (42). The logic means (42) transfers the RF pulses of the oscillator means (44) to a transmitter (4) for wireless transmission of measured values whenever the P/S converter (62) feeds pulses to another input of the logic, the length and spacing apart of such pulses depending on the measured values.

23 Claims, 1 Drawing Sheet

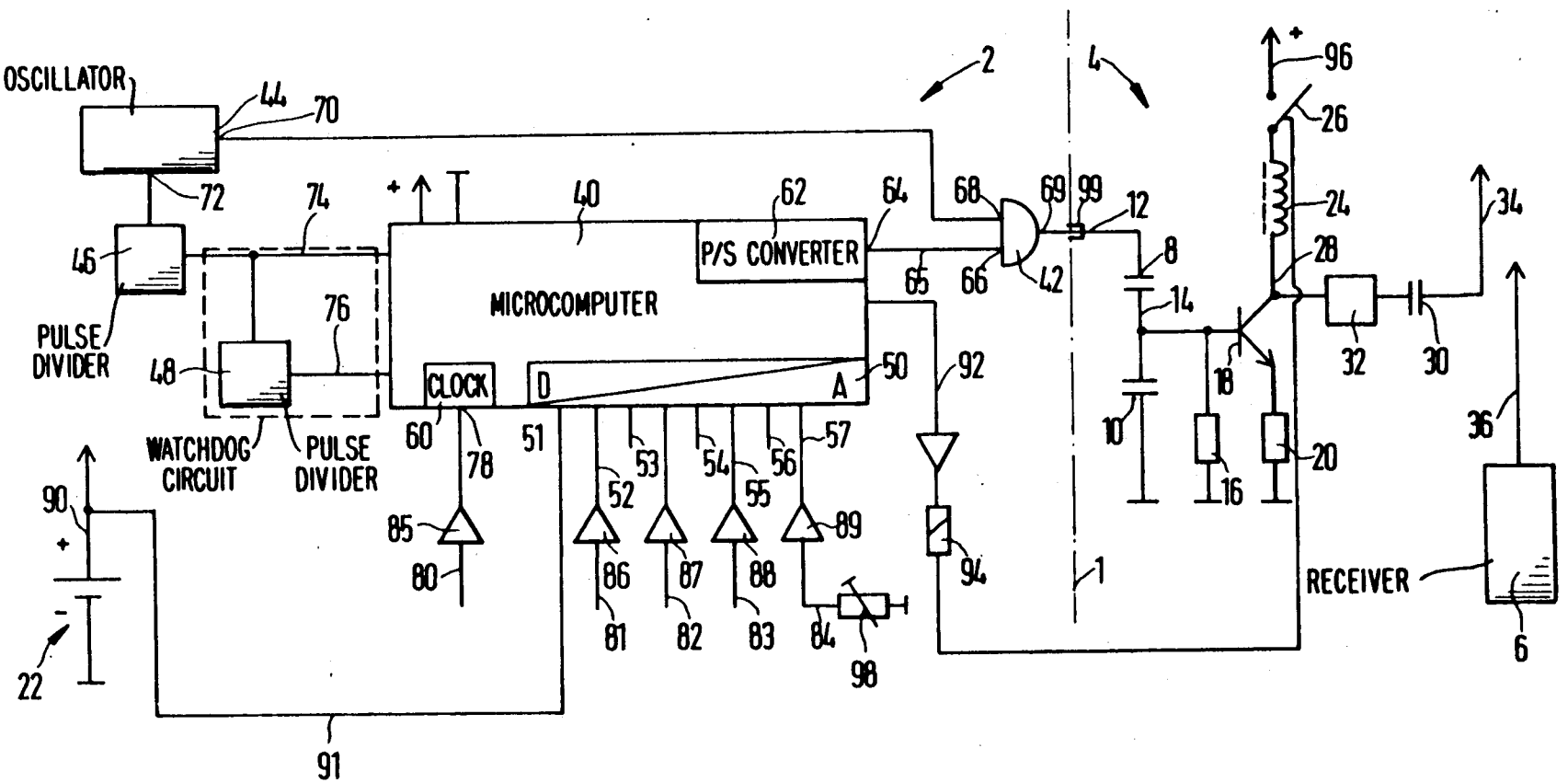
RECEIVER
MICROCOMPUTER
P/S CONVERTER
CLOCK
A
D
PULSE DIVIDER
WATCHDOG CIRCUIT
PULSE DIVIDER
OSCILLATOR

APPARATUS FOR THE PREPARATION AND WIRELESS TRANSMISSION OF MEASURED VALUES

BACKGROUND OF THE INVENTION

The invention relates to a system for the processing and wireless transmission of measured values.

SUMMARY OF THE INVENTION

Known telemetry systems for processing and transmission of analog measurements, or delivery of analog measurements to a transmitter by frequency modulation, are very expensive. The known telemetry systems are also especially sensitive when miniaturized, since their production requires a great deal of precision work.

An object of the invention is to solve these problems by creating a system for the processing and wireless transmission of measurements which is simple even in miniaturized form and can be manufactured at reasonable cost. Furthermore, the system is to have a high reliability of operation.

The aforementioned problems are solved in accordance with the invention in a system in which analog measured values are processed by an analog-to-digital ("A/D") converter and/or digital measured values are processed by a timer in a microcomputer and are then fed through a parallel-to-serial ("P/S") converter to a logic means. Radio frequency ("RF") pulses are also fed by an oscillator means, e.g., a quartz oscillator, to another input of the logic means. The logic means transfers RF pulses of the oscillator means to a transmitter for wireless transmission of the measured values whenever the P/S converter feeds pulses to yet another input of the logic means, the length and spacing apart of such pulses depending on the measured values.

The invention offers the following advantages: few components are necessary; the components are small; the components are commonly sold and therefore reasonable in price; the apparatus can be manufactured simply as a small, powerful module; and high reliability of operation.

The apparatus in accordance with the invention can be constructed as a very small module which is substantially smaller than known telemetry apparatus. It is thus possible to install the apparatus of the invention in rotating parts, e.g., in shafts, couplings, gears and the like, and to transmit measured values wirelessly from these parts to external parts which are stationary relative to the rotating parts or are rotating at a different speed. The transmittable measured values can correspond to rotatory speeds, pressures, temperatures, torques, mechanical forces and mechanical tensions and the like.

DESCRIPTION OF THE DRAWINGS

The invention will be described below in detail with reference to the drawing. The drawing shows, in FIG. 1, a diagrammatic and partially schematic representation of the apparatus in accordance with the invention.

DETAILED DESCRIPTION OF THE INVENTION

The apparatus in accordance with the invention, for the processing and wireless transmission of measured values, is preferably configured overall as a module in accordance with the drawing. As is indicated schematically by a dash-dotted line 1, the apparatus consists essentially of a measured data processing unit 2 and a transmitter 4 which transmits the data processed by the processing unit 2 wirelessly to a receiver 6.

The transmitter 4 is a conventional RF transmitter with two coupling condensers 8 and 10 at the transmitter input 12, a matching resistance 16 connected to each of the connecting lines 14 between the two coupling condensers, and a transistor 18. The transistor 18 is connected on the one hand through a power limiting resistance 20 to the negative potential of a voltage source 22 and on the other hand through a choke 24 and a switch 26 to the positive potential of the voltage source 22. The branch 28 of the transistor 18, which is connected to the choke 24, is furthermore connected through a condenser 30 and preferably also a low-pass filter 32 to a transmitting antenna 34. Signals are wirelessly transmitted by the transmitting antenna 34 to an antenna 36 of the receiver 6.

In a variant embodiment, instead of an electrical RF transmitter 4 and RF receiver 6, an optical transmitting diode and an optical receiving diode could be used.

The measured data processing unit 2 according to the invention contains a microcomputer 40, a logic means 42, an oscillator means 44, which is preferably a quartz oscillator, a first pulse divider 46 and a second pulse divider 48. An A/D converter 50 with a plurality of analog measurement data inputs 51 to 57, a clock or timer 60 and a P/S converter 62, is integrated into the microcomputer. An output 64 of the microcomputer 40 is formed by the output of the P/S converter 62 and connected to an input 66 of the logic means 42. The logic means 42 is preferably an AND gate, but in an inverted embodiment it can be a NAND gate. An output 70 of the oscillator means 44 is connected to another input 68 of the logic means 42.

The first divider 46 is also connected to an output 72 of the oscillator 44 and divides its frequency in a certain ratio such that the system cycle desired for the microprocessor 40 is formed. This system cycle passes from the first divider 46 through an electrical conductor 74 to the microcomputer 40.

The second divider 48 is connected to line 74 and divides the system cycle produced by the first divider 46 in a certain ratio, so that a monitor cycle is formed which is fed from the second divider 48 through a line 76 to the microcomputer and restores this microcomputer at specific times to a specific initial value. The second divider 48 thus forms part of a monitor circuit, which is also known as a "watchdog" and after every cycle restores the microcomputer 40 in a known manner to an initial value at which a program begins again to run in the microcomputer. Consequently, in the event of a disturbance in the microcomputer 40, a program can be restarted at a definite moment in time so that the start of the program will be in tune with all of the functions of the microcomputer 40. A disturbance might be, for example, a power interruption or interfering electrical pulses.

The timer 60 has an input 78 for digital data, which can be on-off signals, rotatory speed sensing pulses, frequency sensing pulses, timing pulses and counting pulses. Electrical matching units 85, 86, 87, 88, 89 can be disposed in the data input lines 80, 81, 82, 83, 84 of the digital and analog inputs 78 and 51, 52, 53, 54, 55, 56, 57. They produce a conversion of the values measured by the sensors such that they will be within an electrical value range that is allowable for the inputs. The matching units can be, for example, differential amplifiers, voltage dividers, impedance transformers or electrometer amplifiers. Analog values, such as inputs from strain gauges for the measurement of torque, for the measurement of flexural stresses on shafts and gears, or for the measurement of root stresses in the teeth of gears, can be fed to the analog inputs 51, 52, 53, 54, 55, 56, 57. Also, temperatures and viscosities of transmission oils or motor oils can be measured by sensors in the form of analog signals. The invention is therefore applicable to the analog and/or digital measurement of data of transmissions and drive elements such as clutches and couplings, brakes, shafts and bearings, as well as motors and test stands for transmissions and drive elements and motors.

The positive potential 90 of the voltage source 22 is connected by a line 91 to the input 51 of the analog to digital converter 50. In this manner, in the event of an undersupply of voltage the microcomputer 40 can switch over to a different program by which less current is consumed, for example by reducing the number of data which the microcomputer 40 feeds to the transmitter 4. This different program, which improves power consumption efficiency, and which can be considered also as an emergency program, can cause operation so that, for example, data is transmitted only in the interrupt mode, so that the very high power consumption of the RF transmitter 4 is reduced.

To save electrical energy and also to prevent electromagnetic interference by the transmitter 4, the microcomputer 40 always shuts off the transmitter 4 whenever the microcomputer is processing measurement data. For this purpose the microcomputer 40 actuates a relay 94 through a control line 92, which in turn actuates the switch 26 in one electrical voltage supply line 96 of the transmitter 4. Voltage supply line 96 is connected to the positive side 90 of the voltage source 22. To shut off the transmitter 4, the relay 94 opens switch 26. Shutting off the transmitter 4 to prevent electromagnetic interference is especially desirable during the conversion of measurement data by the A/D converter 50 of the microcomputer 40. On the other hand, the timer 60 of the microcomputer 40 is not so sensitive to electromagnetic interference in the processing of measurement data.

A temperature sensor 98 is connected to the analog input 57 by the measurement data feed line 84 and measures the temperature of the apparatus 2, 4. The temperature data is converted by the A/D converter 50 in the same manner as the other analog measurement data, and after additional processing in the microcomputer 40 they are transmitted by the transmitter 4 to the receiver 6. In this manner data differences relating to temperature can be compensated.

The P/S converter 62 produces at its output 64 pulses whose "lengths" and "distances apart" are a coded representation, in a known manner, on the principle of serial data transfer of the measured values processed by the microcomputer 40. The pulses of the P/S converter 62 pass from its output 64 through a line 65 to the input 66 of the AND gate 42. This AND gate 42 transfers the RF produced by the quartz oscillator 44 from input 68 to output 69, and thus to the transmitter 4 whenever a "logical 1" is present at the other input 66 of the AND gate. In the contrary case, i.e., when a NAND gate 42 is used instead of an AND gate, the pulse RF of the quartz oscillator 44 is transmitted to output 69 and hence to the transmitter 4 whenever a "logical 0" is present at the input 66 of circuit 42.

P/S converters 62 are disclosed, for example, in the book, "Halbleiter-Schaltungstechnik" ["semiconductor circuitry"] by Tietze and Schenk, Springer Verlag, (Berlin, Heidelberg, New York, Tokyo), 1986 edition, especially pages 651 to 663. In accordance with the invention, the transmission of measured values is performed by the P/S converter 62 according to standardized protocols, e.g., the RS 232 standards (DIN 66020, 66022, CCITT V24), or according to the RS 449 standards, also described in the book cited. Such a P/S converter 62 is also referred to as an SCI (serial communication interface).

In accordance with the invention, a common commercial unit is used as the microcomputer 40, in which the P/S converter 62, the A/D converter, and the timer 60 are integrated.

The entire apparatus 2, 4 is configured in accordance with the invention as a single module. Preferably a releasable connection 99 is situated between the output 69 of the logic or circuit 42 of the processing unit 2 and the input 12 of the transmitter 4, so that the transmitter 4 can be separated from the processing unit 2.

The A/D converter 50, timer 60, and the P/S converter 62 form integral components of the microcomputer 40 and, together with the programming of the microcomputer 40, perform the processing of the measured values which the latter is to perform.

I claim:

1. A system for the processing and wireless transmission of measured values, including:

a microcomputer means for preparing transmission signals from measured values;

a timer having an input for receiving digital measured values, wherein the timer is connected to the microcomputer for communicating said digital measured values to the microcomputer;

a logic means having first and second inputs and an output, the first input being connected to an output of the microcomputer for receiving the transmission signals;

a transmitter connected to the output of the logic means for wireless transmission of the transmission signals corresponding to the measured values processed by the microcomputer; and an oscillator means having first and second RF pulse outputs, the first RF pulse output being connected to the second input of the logic means, the second RF pulse output being connected, through a first pulse divider, to the microcomputer for producing a system cycle for the microcomputer, the logic means forwarding the RF pulses of the oscillator means to the transmitter each time that transmission signals are present at the first input of the logic means.

2. The system of claim 1, wherein the logic means is in the form of an AND gate.

3. The system of claim 2, wherein the microcomputer means includes a parallel-to-serial converter, and wherein the first input of the logic means is connected to the parallel-to-serial converter for receiving the transmission signals therefrom.

4. The system of claim 1, wherein the logic means is in the form of a NAND gate.

5. The system of claim 4, wherein the microcomputer means includes a parallel-to-serial converter, and wherein the first input of the logic means is connected to the parallel-to-serial converter for receiving the transmission signals therefrom.

6. The system of claim 1, wherein the timer is an integral component of the microcomputer.

7. The system of claim 1 wherein the microcomputer means, the timer, the logic means, the transmitter and the oscillator means are packaged together as an integral module.

8. The system of claim 7, wherein the transmitter is releasably connected to the module.

9. The system of claim 1, wherein the system cycle for the computer, produced by the first pulse divider, is also connected to the microcomputer through a second pulse divider for providing a divided system cycle, and wherein the divided system cycle actuates a watchdog circuit of the microcomputer, by which the microcomputer is restored to an initial value at defined times.

10. The system of claim 1, further comprising a switch connected to the microcomputer means and the transmitter, which shuts off the transmitter each time and for as long as the microcomputer processes measured values.

11. A system for the processing and wireless transmission of measured values, including:

a microcomputer means for preparing transmission signals from measured values;

an analog-to-digital converter having an input for receiving analog measured values, wherein the analog-to-digital converter is connected to the microcomputer for communicating said measured values to the microcomputer;

a logic means having first and second inputs and an output, the first input being connected to an output of the microcomputer for receiving the transmission signals;

a transmitter connected to the output of the logic means for wireless transmission of the transmission signals corresponding to the measured values processed by the microcomputer; and an oscillator means having first and second RF pulse outputs, the first RF pulse output being connected to the second input of the logic means, the second RF pulse output being connected, through a first pulse divider, to the microcomputer for producing a system cycle for the microcomputer, the logic means forwarding the RF pulses of the oscillator means to the transmitter each time that transmission signals are present at the first input of the logic means.

12. The system of claim 11, wherein the logic means is in the form of an AND gate.

13. The system of claim 12, wherein the microcomputer means includes a parallel-to-serial converter, and wherein the first input of the logic means is connected to the parallel-to-serial converter for receiving the transmission signals therefrom.

14. The system of claim 11, wherein the logic means is in the form of a NAND gate.

15. The system of claim 14, wherein the microcomputer means includes a parallel-to-serial converter, and wherein the first input of the logic means is connected to the parallel-to-serial converter for receiving the transmission signals therefrom.

16. The system of claim 11, wherein the analog-to-digital converter is an integral component of the microcomputer.

17. The system of claim 11 wherein the microcomputer means, the analog-to-digital converter, the logic means, the transmitter and the oscillator means are packaged together as an integral module.

18. The system of claim 17, wherein the transmitter is releasably connected to the module.

19. The system of claim 11, wherein the system cycle for the computer, produced by the first pulse divider, is also connected to the microcomputer through a second pulse divider for providing a divided system cycle, and wherein the divided system cycle actuates a watchdog circuit of the microcomputer, by which the microcomputer is restored to an initial value at defined times.

20. The system of claim 11, further comprising a switch in signal communication with the microcomputer means and the transmitter, which shuts off the transmitter each time and for as long as the analog-to-digital converter is converting measured values.

21. The system of claim 11, further comprising a switch in signal communication with the microcomputer means and the transmitter, which shuts off the transmitter each time and for as long as the microcomputer processes measured values.

22. The system of claim 11, wherein the analog-to-digital converter has an input for measuring a supply voltage, and wherein, in the event of a measured voltage under-supply, the microcomputer switches over to an emergency program in which less energy is consumed than in the use of a main program.

23. The system of claim 11, wherein the analog-to-digital converter has an input which is connected to a temperature sensor for measuring a temperature of the system, and wherein the temperature measurement is processed by the microcomputer means into transmission signals for transmission.

* * * * *